US007775216B2

(12) United States Patent
Koide et al.

(10) Patent No.: US 7,775,216 B2
(45) Date of Patent: Aug. 17, 2010

(54) CARBONACEOUS HEAT SOURCE COMPOSITION FOR NON-COMBUSTION-TYPE SMOKING ARTICLE

(75) Inventors: Akihiro Koide, Yokohama (JP); Kazuhiko Katayama, Yokohama (JP); Manabu Takeuchi, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 459 days.

(21) Appl. No.: 11/819,292

(22) Filed: Jun. 26, 2007

(65) Prior Publication Data

US 2007/0245623 A1 Oct. 25, 2007

Related U.S. Application Data

(63) Continuation of application No. PCT/JP2005/023592, filed on Dec. 22, 2005.

(30) Foreign Application Priority Data

Jan. 6, 2005 (JP) ..... 2005-001598

(51) Int. Cl.
*A24F 47/00* (2006.01)

(52) U.S. Cl. ..... 131/271; 131/359

(58) Field of Classification Search ..... None
See application file for complete search history.

(56) References Cited

U.S. PATENT DOCUMENTS

| | | | |
|---|---|---|---|
| 4,854,331 | A | 8/1989 | Banerjee et al. |
| 4,881,556 | A | 11/1989 | Clearman et al. |
| 4,989,619 | A | 2/1991 | Clearman et al. |
| 5,040,552 | A | 8/1991 | Schleich et al. |
| 5,076,297 | A | 12/1991 | Farrier et al. |
| 5,188,130 | A | 2/1993 | Hajaligol et al. |
| 5,247,949 | A | 9/1993 | Deevi et al. |
| 5,595,577 | A | 1/1997 | Bensalem et al. |
| 2004/0173229 | A1 | 9/2004 | Crooks et al. |
| 2004/0226568 | A1 | 11/2004 | Takeuchi et al. |

FOREIGN PATENT DOCUMENTS

| | | | |
|---|---|---|---|
| EP | 0 494 784 | A2 | 7/1992 |
| JP | 63-164875 | A | 7/1988 |
| JP | 2-215373 | A | 8/1990 |
| JP | 3-272675 | A | 12/1991 |
| JP | 4-367582 | A | 12/1992 |
| JP | 10-179112 | A | 7/1998 |
| JP | 2919835 | B2 | 4/1999 |
| JP | 3016586 | B2 | 12/1999 |
| SU | 1556527 | A3 | 4/1990 |
| WO | WO-03/056949 | A1 | 7/2003 |

*Primary Examiner*—Philip C Tucker
*Assistant Examiner*—Michael J Felton
(74) *Attorney, Agent, or Firm*—Birch, Stewart, Kolasch & Birch, LLP

(57) ABSTRACT

A carbonaceous heat source composition for a non-combustion-type smoking article contains calcium carbonate in an amount of 30 to 55% by weight.

4 Claims, 1 Drawing Sheet

CARBONACEOUS HEAT SOURCE COMPOSITION FOR NON-COMBUSTION-TYPE SMOKING ARTICLE

CROSS-REFERENCE TO RELATED APPLICATIONS

This is a Continuation Application of PCT Application No. PCT/JP2005/023592, filed Dec. 22, 2005, which was published under PCT Article 21(2) in Japanese.

This application is based upon and claims the benefit of priority from prior Japanese Patent Application No. 2005-001598, filed Jan. 6, 2005, the entire contents of which are incorporated herein by reference.

BACKGROUND OF THE INVENTION

1. Field of the Invention

The present invention relates to a carbonaceous heat source composition for a non-combustion-type smoking article.

2. Description of the Related Art

Tobacco is a typical flavor-generating material for which the flavor in the smoke (aerosol) generated by combusting the tobacco leaves is enjoyed through gustatory or olfactory organs of human.

In recent years, in place of, or in addition to, tobacco, non-combustion-type smoking articles have been developed for enjoying the flavor and taste of tobacco and for enjoying the aerosol, without combusting the tobacco leaves. These non-combustion-type smoking articles comprise a heat source which is a heat-generating member mounted on the tip and a flavor-generating member in which a flavoring component is held in an appropriate substrate. The heat source is physically separated from the flavor-generating member generating the aerosol containing the flavoring component. In the smoking articles of this type, the heat source is combusted, and the heat of combustion heats the flavor-generating member without combustion to generate an aerosol containing the flavoring component. The smoker inhales the aerosol to enjoy the flavor.

A carbonaceous heat source is used exclusively as the heat source. Various proposals have been presented for decreasing the amount of carbon monoxide that is generated during combustion of the heat source.

For example, Jpn. Pat. Appln. KOKAI Publication No. 2-215373 discloses a heat source body containing a metal carbide, carbon and a binder is disclosed in, for example. In this heat source body, the particle diameter and the specific surface area of the metal carbide are controlled to enhance the combustion rate of the heat source and to decrease the amount of carbon monoxide. Jpn. Pat. Appln. KOKAI Publication No. 3-272675 discloses a heat source body containing a metal nitride, carbon and a binder. In this heat source body, the metal nitride forms a metal oxide by combustion, and the metal oxide promotes the conversion of carbon monoxide into carbon dioxide, thereby decreasing the amount of carbon monoxide. U.S. Pat. No. 4,881,556 discloses a carbonaceous fuel element containing carbon and a binder. In this fuel element, the density and the shape of the fuel element are changed so as to enhance the combustibility of the fuel element, thereby decreasing the amount of carbon monoxide. Further, U.S. Pat. No. 5,595,577 discloses a carbonaceous heat source containing a metal oxide. In this heat source, the amount of carbon monoxide is decreased by the metal oxide deposited on the heat source. Further, U.S. Patent Application Publication No. US 2004/0173229 A1 discloses a combustible material containing an ultra fine metal catalyst. In this combustible material, the metal catalyst converts carbon monoxide to carbon dioxide, thereby decreasing the amount of carbon monoxide. Jpn. Pat. Appln. KOKAI Publication No. 10-179112 discloses a heat source composition containing carbon, a binder, a non-combustible graphite and potassium. In this heat source composition, the amount of carbon monoxide is decreased by controlling the amount of potassium.

These prior art carbonaceous heat sources are still insufficient in terms of decreasing the amount of carbon monoxide. In addition, the heat source using a catalyst for oxidizing carbon monoxide involves the reliability problem of the smoking article. Also, as a means for decreasing the amount of carbon monoxide introduced into the mouth, it is conceivable to provide the filter mounted on the smoking article with a ventilation effect. However, the filter ventilation greatly changes the flavor and taste of the article by the dilution with air.

BRIEF SUMMARY OF THE INVENTION

An object of the present invention is to provide a heat source composition for a non-combustion-type smoking article, which can further decrease the amount of carbon monoxide that is generated by the combustion of the heat source, without involving the reliability problem caused by using additives including a catalyst for oxidizing carbon monoxide and without involving the change in the flavor and taste caused by the filter ventilation.

For achieving the object described above, the present invention provides a carbonaceous heat source composition for a non-combustion-type smoking article, which contains calcium carbonate in an amount of 30 to 55% by weight.

DETAILED DESCRIPTION OF THE INVENTION

Figure 1:
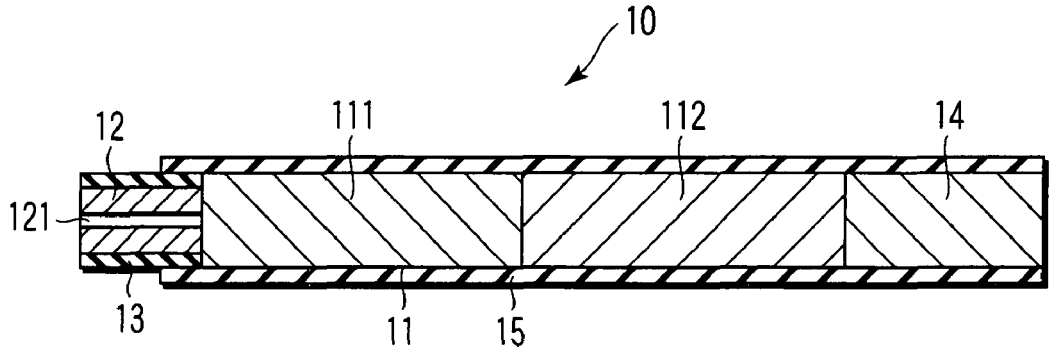
FIG. 1 is a cross-sectional view illustrating one example of a non-combustion-type smoking article.

The present invention will now be described below in more detail.

A carbonaceous heat source composition for a non-combustion-type smoking article according to the present invention contains 30 to 55% by weight of calcium carbonate (particles). If the amount of calcium carbonate is smaller than 30% by weight, the amount of carbon monoxide generated cannot be decreased effectively. On the other hand, if the amount of calcium carbonate exceeds 55% by weight, the number of puffs of the smoking article is markedly decreased, which is practically inappropriate.

Usually, the carbonaceous heat source composition of the present invention contains a binder in addition to calcium carbonate and carbon in order to bond the calcium carbonate with carbon. The amount of the binder is preferably 5 to 15% by weight. If the amount of the binder is smaller than 5% by weight, the binder tends to fail to exhibit its bonding strength sufficiently. On the other hand, if the amount of the binder exceeds 15% by weight, the amount of carbon contained in the heat source composition is decreased, with the result that the heat source tends to fail to undergo combustion sufficiently.

As the binder, use may be made of, e.g., an alginate salt, a carboxymethyl cellulose or a salt thereof, pectin or a salt thereof, carrageenan or a salt thereof, and guar gum.

As described above, the carbonaceous heat source of the present invention contains 30 to 55% by weight of calcium carbonate, and the balance is carbon, including the case where the heat source contains the binder. The source of carbon (particles) is not particularly limited, and any known carbons can be used.

The carbonaceous heat source composition of the present invention can reduce the amount of carbon monoxide generated by the combustion of the heat source to 60% or less, compared with the general smoking article using a carbonaceous heat source.

The mechanism in which the carbonaceous heat source composition of the present invention markedly reduces the amount of carbon monoxide generated has not yet been clarified. However, it is considered that one reason is that the combustion temperature of the carbonaceous heat source composition of the present invention is relatively low. That is, the combustion temperature of the carbonaceous heat source composition of the present invention is not higher than 1,000° C. It is generally known that the amount of carbon monoxide generated is increased with increase in the combustion temperature. Since the highest temperature that can be reached by the combustion of the carbonaceous heat source of the present invention is not higher than 1,000° C., it is considered that the amount of carbon monoxide generated is markedly reduced.

Incidentally, where calcium carbonate having a particle diameter of 0.08 to 0.15 μm is used as the calcium carbonate in the carbonaceous heat source composition of the present invention, the amount of carbon monoxide generated during combustion in smoking can be further reduced, compared with the case of using calcium carbonate having a particle diameter exceeding 18 μm. For example, when the amounts of calcium carbonate in the carbonaceous heat source compositions are the same, use of calcium carbonate having a particle diameter falling within a range of 0.08 to 0.15 μm can reduce the amount of carbon monoxide generated to 50 to 80% of the amount of carbon monoxide generated by using calcium carbonate having a particle diameter exceeding 18 μm.

The carbonaceous heat source composition of the present invention can be molded as a heat source by the molding technology such as extrusion molding.

The heat source obtained from the carbonaceous heat source composition of the present invention can be used as a heat source in various non-combustion-type smoking articles in which the heat source and the aerosol-generating material are arranged to be physically separated from each other.

One example of a non-combustion-type smoking article using a heat source composed of the carbonaceous heat source composition of the present invention will now be described with reference to FIG. 1.

A non-combustion-type smoking article 10 illustrated in FIG. 1 comprises an aerosol-generating section 11, which generates, by being heated, an aerosol containing a flavoring component. In the example illustrated in FIG. 1, the aerosol-generating section 11 is composed of a first aerosol-generating portion 111 and a second aerosol-generating portion 112. The first aerosol-generating portion 111 comprises a hollow cylinder made of a thermally stable material such as aluminum or stainless steel, in which sheet tobacco shreds or tobacco shreds, for example, are filled. The second aerosol-generating portion 112 comprises a similar hollow cylinder in which tobacco shreds, for example, are filled. The first aerosol-generating portion 111 and the second aerosol-generating portion 112 are in contact with each other and positioned in the longitudinal direction of the smoking article 10.

A carbonaceous heat source 12 formed of a composition according to the present invention is provided at the front end of the aerosol-generating section 11 (the front end of the first aerosol-generating portion 111) so as to be physically separated from the aerosol-generating section 11. A through-hole 121 for taking in the outer air is formed within the heat source 12 in the axial direction. In general, the outer circumferential surface of the heat source 12 is surrounded by a heat resistant member 13 consisting of, for example, glass wool. Also, an ordinary filter 14 can be provided at the rear end of the aerosol-generating section 11 (the rear end of the second aerosol-generating portion 112). Further, the entire outer circumferential surfaces of the aerosol-generating section 11 and the filter 14 and a part of the circumferential surface of the heat source 12 surrounded by the heat-resistant member 13 are wrapped by a wrapping material 15 made of a heat insulating material to form an integral body. Such non-combustion-type smoking article 10 may have an outer appearance of the ordinary cigarette.

The present invention will be described below by way of Examples, but the present invention is not limited thereby.

Examples 1 to 4 and Comparative Example 1

Carbonaceous heat sources were molded from compositions containing calcium carbonate (12 to 55% by weight), a binder (10% by weight) and carbon (the balance: 78 to 35% by weight), as shown in Table 1. Smoking articles of the construction shown in FIG. 1 were fabricated by using the carbonaceous heat sources. The smoking articles were subjected to a smoking combustion by an automatic smoking machine under the standard smoking conditions (TIOJ standard measuring method, 4th Edition, attachment 1), and the amount of the TPM (total particulate matter) and the carbon monoxide generated were measured. The results are shown in Table 1.

TABLE 1

Calcium carbonate content, amount of carbon monoxide generated and highest combustion temperature

| | Calcium carbonate content (% by weight) | TPM (mg/smoking article) | CO (mg/smoking article) | Highest combustion temperature (° C.) |
|---|---|---|---|---|
| Comp. Ex. 1 | 12 | 0.72 | 10.3 | 1074.5 |
| Ex. 1 | 30 | 0.68 | 4.4 | 968.4 |
| Ex. 2 | 40 | 0.43 | 3.3 | 913.0 |
| Ex. 3 | 50 | 0.31 | 1.3 | 838.6 |
| Ex. 4 | 55 | 0.24 | 0.8 | — |

As shown in Table 1, the smoking article fabricated by using a carbonaceous heat source containing not less than 30% by weight of calcium carbonate makes it possible to markedly reduce the amount of carbon monoxide generated, compared with the smoking article fabricated by using a carbonaceous heat source containing less than 30% by weight of calcium carbonate. Further, the smoking article fabricated by using a carbonaceous heat source containing not less than 30% by weight of calcium carbonate tends to reduce the TPM, compared with the smoking article fabricated by using a carbonaceous heat source containing less than 30% by weight of calcium carbonate.

In addition, the highest combustion temperature within the heat source was measured when the smoking article of each of Examples 1 to 3 and Comparative Example 1 was subjected to a smoking combustion by an automatic smoking machine under the standard smoking conditions (TIOJ standard measuring method, 4th Edition, attachment 1). The results are shown also in Table 1.

Figure 2:
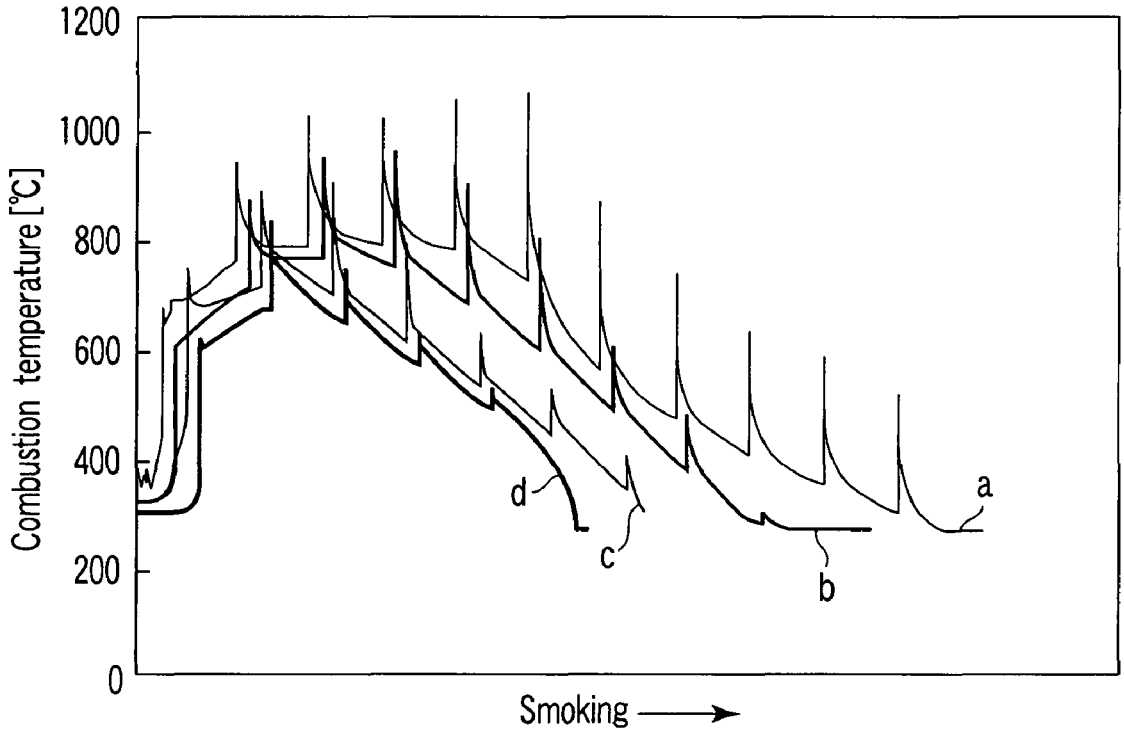
FIG. 2 is a graph showing the temperature history within the carbonaceous heat source during the combustion for the smoking.

FIG. 2 is a graph showing the temperature history within the carbonaceous heat source during the smoking combustion. In FIG. 2, curve a denotes the result for Comparative Example 1, curve b denotes the result for Example 1, curve c denotes the result for Example 2, and curve d denotes the result for Example 3. These curves are deviated from each other in FIG. 2 so as to clearly show the temperature history for each case. The sharp peaks of each curve in FIG. 2 denote the puffs.

During the smoking combustion of the smoking article using the carbonaceous heat source, the combustion temperature becomes highest in the vicinity of the third to fifth puff. In the case of using the carbonaceous heat source containing not less than 30% by weight of calcium carbonate, the highest combustion temperature is not higher than 1,000° C. As apparent from the data given in Table 1, the amount of carbon monoxide generated is markedly reduced in the case where the combustion temperature is not higher than 1,000° C.

Examples 5 to 10

Heat sources were prepared by changing the particle diameter of calcium carbonate as shown in Table 2, with the proportion of the components fixed, i.e., with calcium carbonate fixed at 30% by weight, a binder at 10% by weight, and carbon at 50% by weight. Smoking articles of the construction shown in FIG. 1 were fabricated by using the resultant carbonaceous heat sources. The smoking articles were subjected to a smoking combustion by an automatic smoking machine under the standard smoking conditions (TIOJ standard measuring method, 4th Edition, attachment 1) and the amount of carbon monoxide generated was measured. The results are shown in Table 2.

TABLE 2

| | Particle diameter of calcium carbonate (calcium carbonate content 40% by weight) and amount of carbon monoxide generated | | |
|---|---|---|---|
| | Particle diameter (μm) | Amount of CO generated (mg) | CO generation ratio (%) |
| Ex. 5 | 24.0 | 4.0 | 100 |
| Ex. 6 | 18.0 | 4.0 | 100 |
| Ex. 7 | 10.5 | 3.9 | 97.5 |
| Ex. 8 | 3.2 | 3.3 | 82.5 |
| Ex. 9 | 0.15 | 2.8 | 70.0 |
| Ex. 10 | 0.08 | 2.3 | 57.5 |

Where the amount of carbon monoxide generation is set at 100% in the case of the smoking article fabricated by using a carbonaceous heat source containing calcium carbonate having a particle diameter not less than 18 μm, it is possible to reduce to 70 to 57.5% the carbon monoxide generation amount of the smoking article fabricated by using a carbonaceous heat source containing calcium carbonate having a particle diameter falling within a range of 0.15 to 0.08 μm. In other words, where the same amount of calcium carbonate is contained in the carbonaceous heat source, use of calcium carbonate having a particle diameter falling within a range of 0.15 to 0.08 μm makes it possible to further decrease the amount of carbon monoxide generated.

As described above, the present invention can provide a carbonaceous heat source composition, which can reduce the amount of carbon monoxide generated, while eliminating the problem in terms of the reliability of the smoking article that is caused by the use of an additive such as a catalyst for oxidizing carbon monoxide and also eliminating the problem that the flavor and taste of the smoking article are changed by the marked change in the design of the smoking article such as employment of the filter ventilation, by taking a simple measure that the amount of calcium carbonate is set to fall within a range of 30 to 55% by weight in a heat source composition for a non-combustion-type smoking article.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A carbonaceous heat source composition for a non-combustion-type smoking article, which comprises calcium carbonate in an amount of 30 to 55% by weight, wherein the calcium carbonate has a particle diameter falling within a range of 0.08 to 0.15 μm.

2. The carbonaceous heat source composition according to claim 1, wherein a combustion temperature of the composition under the standard smoking conditions is not higher than 1,000° C.

3. The carbonaceous heat source composition according to claim 1, which further contains a binder.

4. The carbonaceous heat source composition according to claim 3, wherein the binder is contained in an amount of 5 to 15% by weight.

* * * * *